US009655463B2

(12) United States Patent
Madala

(10) Patent No.: US 9,655,463 B2
(45) Date of Patent: May 23, 2017

(54) INSULATED BEVERAGE-CONTAINER HOLDER

(71) Applicant: William G. Madala, Racine, WI (US)

(72) Inventor: William G. Madala, Racine, WI (US)

( * ) Notice: Subject to any disclaimer, the term of this patent is extended or adjusted under 35 U.S.C. 154(b) by 6 days.

(21) Appl. No.: 14/073,383

(22) Filed: Nov. 6, 2013

(65) Prior Publication Data

US 2015/0122828 A1 May 7, 2015

(51) Int. Cl.
*B65D 51/18* (2006.01)
*A47G 23/02* (2006.01)
*B65D 81/38* (2006.01)

(52) U.S. Cl.
CPC ..... *A47G 23/0266* (2013.01); *B65D 81/3876* (2013.01)

(58) Field of Classification Search
CPC ..... A47G 19/2288; A47G 23/0233; A47G 23/0266; A47J 41/0077; B65D 1/265; B65D 81/3886; B65D 81/3869; B65D 81/3876; B65D 81/3865; B65D 51/18; B65D 51/24
USPC ..... 220/253, 254, 254.3, 820, 910, 259.2, 220/254.6, 739, 737, 903, 259.1, 256.1, 220/212.5, 212, 592.17; 206/365; D9/517, 455
See application file for complete search history.

(56) References Cited

U.S. PATENT DOCUMENTS 3,905,511 A 9/1975 Groendal
4,369,888 A * 1/1983 Walter ..... B65D 47/141 215/237
4,494,672 A 1/1985 Pearson
4,561,563 A 12/1985 Woods
4,615,463 A 10/1986 Price et al.
4,690,300 A 9/1987 Woods
4,720,023 A * 1/1988 Jeff ..... 220/592.17
4,735,333 A 4/1988 Lay et al.
4,752,016 A * 6/1988 Eads ..... 220/253
4,872,577 A 10/1989 Smith
4,927,047 A 5/1990 Stuber et al.
D361,923 S 9/1995 Smith
5,609,277 A 3/1997 McDonald
5,653,124 A 8/1997 Weber
5,740,940 A 4/1998 Weiss
6,039,207 A 3/2000 Adamek
6,604,649 B1 8/2003 Campi
6,755,318 B2 * 6/2004 Burke ..... G01F 11/262 220/23.88

(Continued)

*Primary Examiner* — Anthony Stashick
*Assistant Examiner* — James M Van Buskirk
(74) *Attorney, Agent, or Firm* — Jansson Munger McKinley & Kirby Ltd.

(57) ABSTRACT

An insulating beverage-can holder including: a can-receiving cup; a primary lid that is secured to the upper edge of the cup and has (a) a main portion defining a drinking hole aligned with the can opening, (b) a disk of resiliently-deformable material on the underside of the main portion to form a seal about the can opening and having an aperture aligned with the drinking hole, and (c) a circumferential rim disposed to form a seal around the edge of the cup; and a secondary lid which is hinged to the primary lid at opposite sides of the main portion and is movable between a first position exposing the drinking hole and a second position closing the drinking hole and covering an area of the primary lid.

18 Claims, 6 Drawing Sheets

(56) References Cited

U.S. PATENT DOCUMENTS

| | | | | |
|---|---|---|---|---|
| 7,201,285 | B2 | 4/2007 | Beggins | |
| 8,240,498 | B2 * | 8/2012 | Ramsey et al. | 220/254.3 |
| 8,371,464 | B2 * | 2/2013 | Rachuk et al. | 215/230 |
| 2010/0251731 | A1 | 10/2010 | Bergida | |
| 2012/0305571 | A1 | 12/2012 | Larsen | |

* cited by examiner

INSULATED BEVERAGE-CONTAINER HOLDER

FIELD OF THE INVENTION

This invention relates generally to beverage containers, and, more specifically, to the field of insulating beverage-container holders.

BACKGROUND OF THE INVENTION

Many billions of beverages in beverage cans are consumed each year worldwide. Considerable attention has been given to developing insulating containers for beverages and, in particular, for beverage-container holders.

The insulating properties available for most standard twelve-ounce metal beer and soft-drink cans and the like are limited, even when an insulating beverage container holder is used. Once opened, such containers typically cannot be closed, a factor that causes loss of insulation, potential spillage, potential for contamination and other inconveniences. Various developments have occurred in the field of insulated beverage containers and holders for containers. Some of these are disclosed in U.S. Pat. Nos. 3,905,511, 4,561,563, 4,615,463, 4,872,577, 5,653,124, 6,604,649 and U.S. Published patent application Ser. No. 13/067,473.

While beverage-container holders of the prior art provide some advantages in insulation and convenience, there remains a need for a beverage-container holder that is of simple construction and has advantages of continuous insulation around every surface of the enclosed beverage container, secureness against spillage and movement of the enclosed beverage container relative to the beverage-container holder, and convenience in use.

SUMMARY OF THE INVENTION

The present invention is an improved insulating beverage-container holder of the type including (a) a lower container-receiving cup having an upper edge and (b) an upper lid structure, the cup and lid structure together configured to enclose a standard-shape beverage can having a bead and a top surface with an offset opening near the bead. In the invention, the lid structure has two principal parts, namely, a primary lid and a secondary lid, each having particular elements and characteristics.

The improved insulating beverage-container holder overcomes problems of prior art devices and is convenient and highly useful in a wide variety of canned beverage drinking situations.

The primary lid includes (1) a main portion secured to the upper edge of the cup and defining an offset drinking hole alignable with the can opening and (2) a disk of resiliently-deformable insulating material on the underside of the main portion disposed to form a fluid-impermeable seal about the can opening, the disk having an aperture aligned with the drinking hole. The secondary lid is hinged to the primary lid at opposite sides of the main portion, and is movable between a first position which exposes the drinking hole and a second position which closes the drinking hole and covers an area of the primary lid therearound.

In highly preferred embodiments, the primary lid is hinged to the upper edge of the cup and the lid structure is movable about the hinge between a can-admitting/removing open position and a can-enclosing closed position. In certain of such embodiments, the primary lid includes a latch for engagement in the closed position with a latch-catch at the upper edge of the cup.

The primary lid preferably includes a flow-directing member disposed to extend downwardly from the inner-facing wall through the can opening when the primary lid is in the closed position. Such flow-directing member is preferably generally tubular.

In certain preferred embodiments of this invention, the secondary lid includes an underside protrusion which is disposed to extend into the drinking hole when the secondary lid is in the second position. Preferably, the underside protrusion is configured not only to extend into, but also to plug, the drinking hole when the secondary lid is in the second position, thereby forming a fluid-impermeable seal. When the primary lid is in its can-admitting position, the underside protrusion of the secondary lid will preferably remain in engagement with the drinking hole of the primary lid.

For extra convenience in drinking, the cup includes a side handle.

In certain preferred embodiments, the primary lid main portion includes a turret-like raised portion adjacent to the drinking hole, and the secondary lid is hinged at opposite sides of such turret-like raised portion. It is most preferred that the turret-like raised portion and the secondary lid have substantially co-planar top surfaces when the secondary lid is in the second position. In some cases, the turret-like raised portion and the secondary lid have top surfaces at least one of which bears readable indicia, such as indicia promoting a particular brand of beverage, a particular sports team, or a particular company.

In some preferred embodiments, the disk of the primary lid is disposed to sealingly engage the bead of the beverage can when the primary lid is in the closed position. This avoids or minimizes any internal spillage.

Another aspect of the improvement of this invention involves a primary lid secured to the upper edge of the cup, the primary lid including (1) a main portion defining an offset drinking hole alignable with the can opening and (2) a disk of resiliently-deformable insulating material on the underside of the main portion disposed to form a fluid-impermeable seal about the can opening, such disk having an aperture aligned with the drinking hole. A secondary lid is hinged to the primary lid at opposite sides of the main portion. The secondary lid is movable between a first position exposing the drinking hole and a second position closing the drinking hole and covering an area of the primary lid therearound. In such second position, the secondary lid forms a fluid-impermeable secondary seal 360° around the drinking hole, such secondary seal being formed at points of frictional contact between the underside of the secondary lid and an adjacent upperside of the primary lid.

In some embodiments, the underside of the secondary lid is preferably formed of a deformably-resilient polymer; and in some embodiments the underside of the secondary lid is of hard plastic and the upperside of the primary lid is of a deformably-resilient polymer.

Still another aspect of the improvement of this invention involves a primary lid secured to the upper edge of the cup, the primary lid including: (1) a main portion which defines an offset drinking hole alignable with the can opening; (2) a disk of resiliently-deformable insulating material on the underside of the main portion, such disk being disposed to form a fluid-impermeable seal about the can opening and having an aperture aligned with the drinking hole; and (3) an edge-engaging circumferential rim disposed to form a fluid-impermeable seal 360° around the edge of the cup. A secondary lid is hinged to the primary lid at opposite sides of the main portion, and, as earlier described, is movable between a first position which exposes the drinking hole and a second position which closes the drinking hole and covers an area of the primary lid therearound.

Preferably, one of the edge-engaging circumferential rim and the edge of the cup is of a deformably-resilient polymer and the other is of hard plastic.

The term "fluid-impermeable" as used herein means that the member involved substantially closes off any flow of liquid.

DETAILED DESCRIPTION OF PREFERRED EMBODIMENTS

Figure 1:
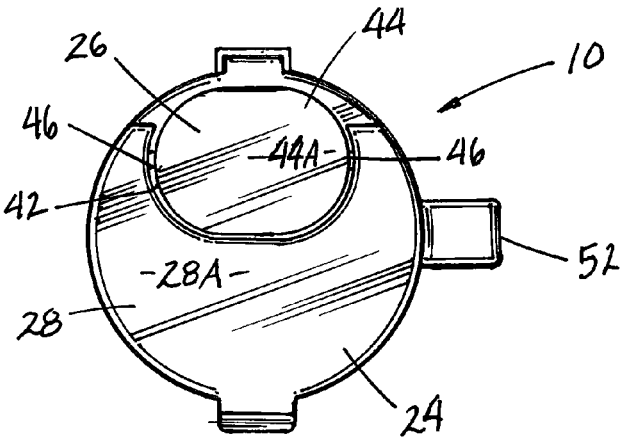
FIG. 1 is a top plan view of an insulating beverage-container holder in accordance with this invention.
Figure 2:
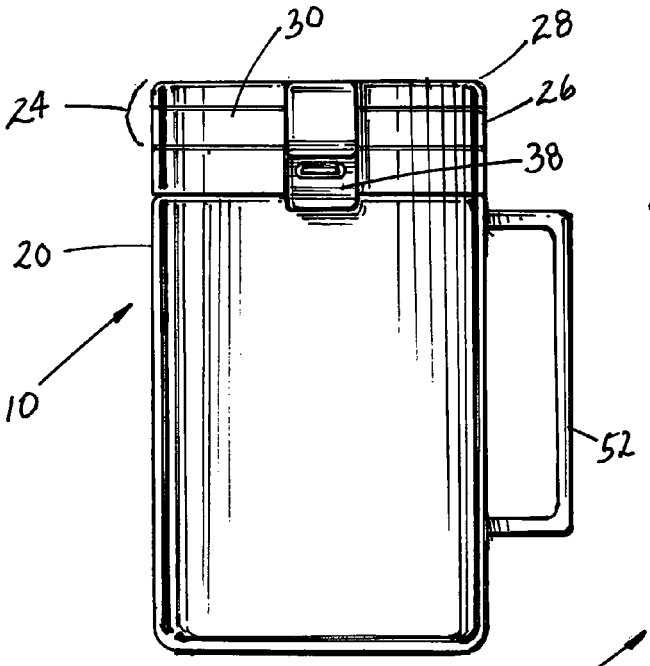
FIG. 2 is a front elevation of the beverage-container holder of FIG. 1.
Figure 3:
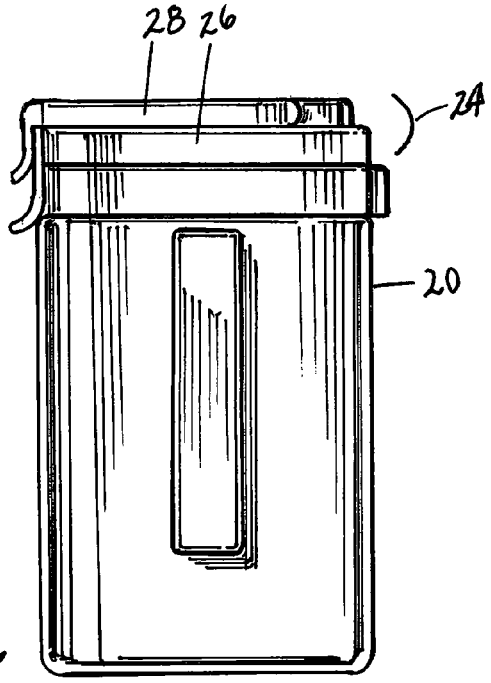
FIG. 3 is a right side elevation.
Figure 4:
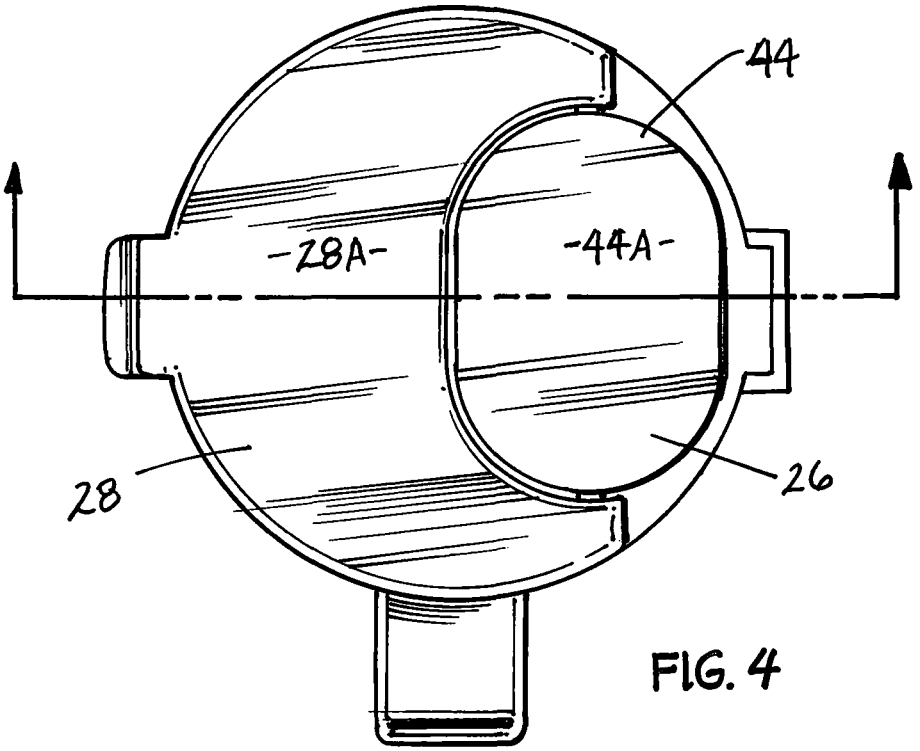
FIG. 4 is an enlarged top plan view as in FIG. 1 but with the holder rotated 90° clockwise.
Figure 5:
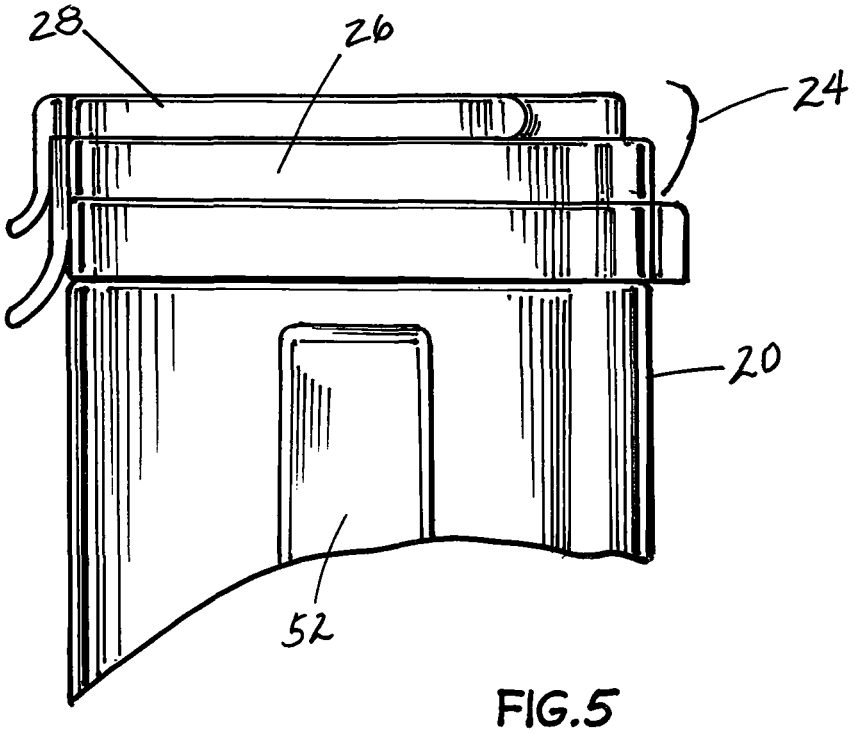
FIG. 5 is a fragmentary right-side elevation as in FIG. 3, but enlarged to match the size of FIG. 4.
Figure 6:
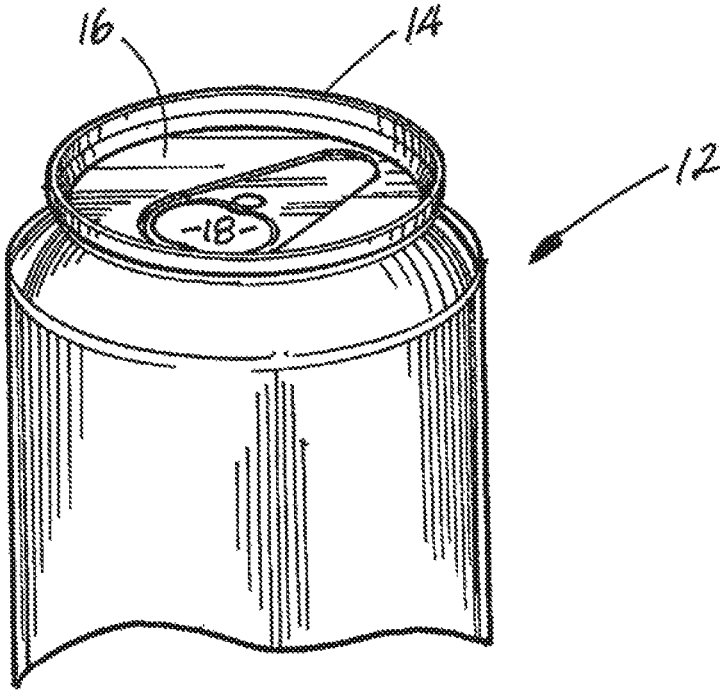
FIG. 6 is a fragmentary perspective view of a standard-shape cylindrical metal beverage can.

FIGS. 1-5 and 7-10 illustrate an improved insulating beverage-container holder 10 in accordance with this invention. This embodiment is for the purpose of containing and facilitating use of a standard-shape beer-and-beverage can 12 (as seen in FIG. 6) of the common type having a bead 14 and a top surface 16 with an offset opening 18 near bead 14. An example of such standard-shape beer-and-beverage cans is the cylindrical metal can seen and described in the September 1994 *Scientific American* article titled "The Aluminum Beverage Can" by William F. Hosford and John L. Duncan.

Figure 10:
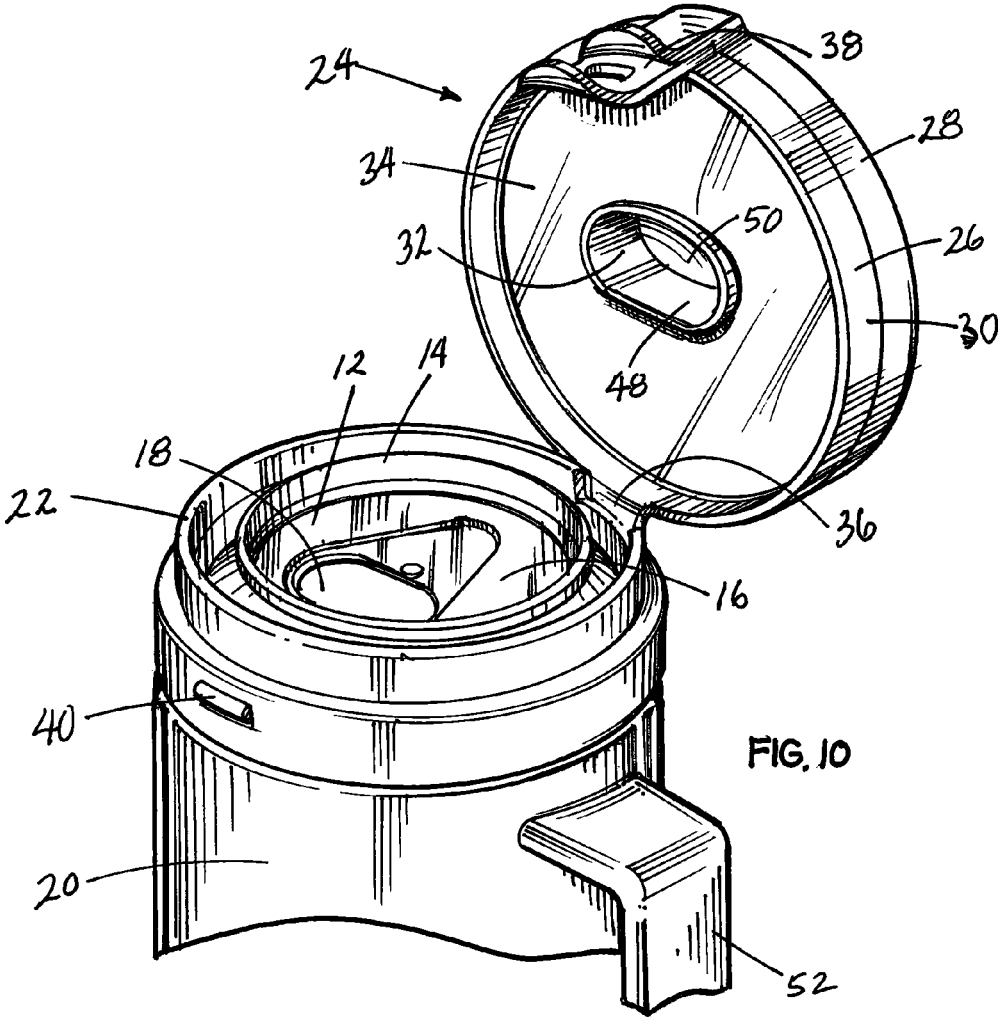
FIG. 10 is a similar fragmentary perspective view but with the primary lid in its open position, exposing a contained beverage can.

Beverage-container holder 10 has two principal structures, namely, a lower container-receiving cup 20 that includes an upper edge 22, best seen in FIG. 10, and an upper lid structure 24. Cup 20, the wall of which is insulating by nature, and lid structure 24 are configured such that together they enclose can 12.

Upper lid structure 24 has two main parts, including a primary lid 26 and a secondary lid 28. The elements, characteristics and details of these two parts of upper lid structure 24 will now be described in detail.

Figure 7:
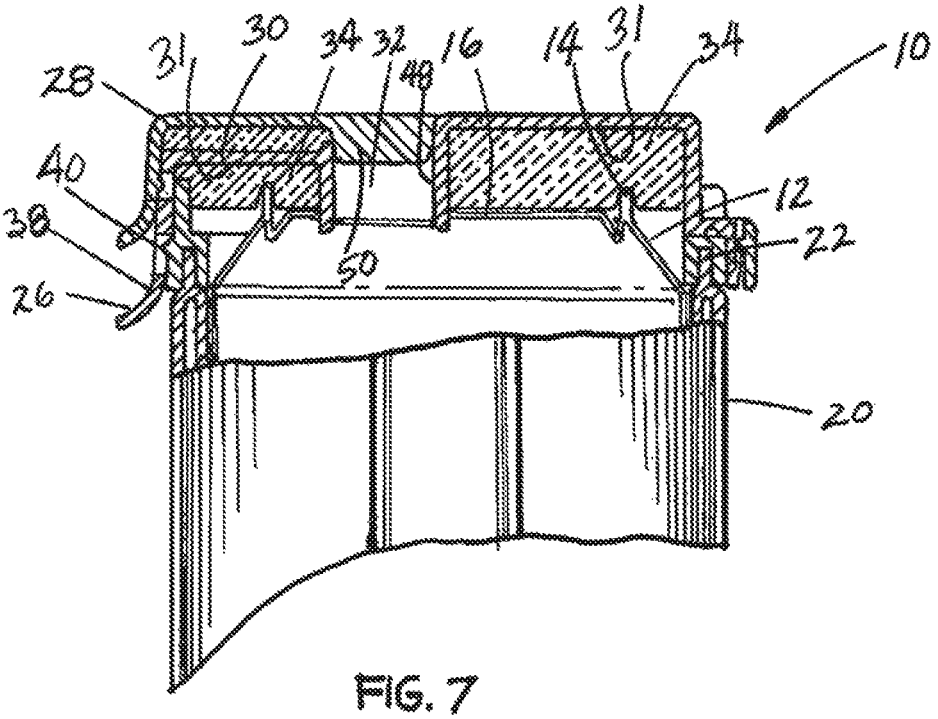
FIG. 7 is a fragmentary sectional view taken along section 7-7 as indicated in FIG. 4.
Figure 8:
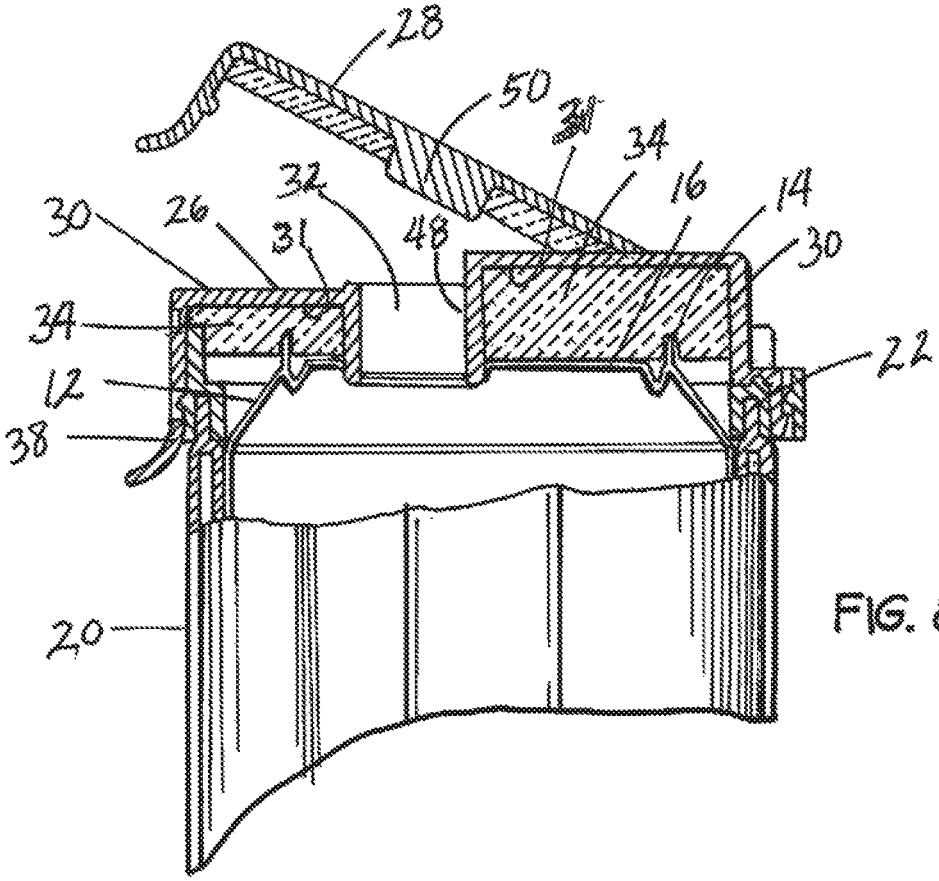
FIG. 8 is a similar fragmentary sectional view but with the secondary lid raised somewhat toward its open position and the primary lid in its closed position.

Primary lid 26 includes a main portion 30 that is secured to upper edge 22 of cup 20 and defines an offset drinking hole 32 which, when the product is in use, is aligned with can opening 18. Primary lid 26 also includes a disk 34 of resiliently-deformable insulating material on the underside 31 of main portion 30. Disk 34 is disposed to form a fluid-impermeable seal about can opening 18, and also is disposed to sealingly engage bead 14 of beverage can 12 when primary lid 26 is in the closed, can-enclosing position. This is best seen in FIGS. 7 and 8, and serves to avoid or minimize any internal spillage. Resiliently-deformable disk 34 has an aperture which is aligned with drinking hole 32.

Figure 9:
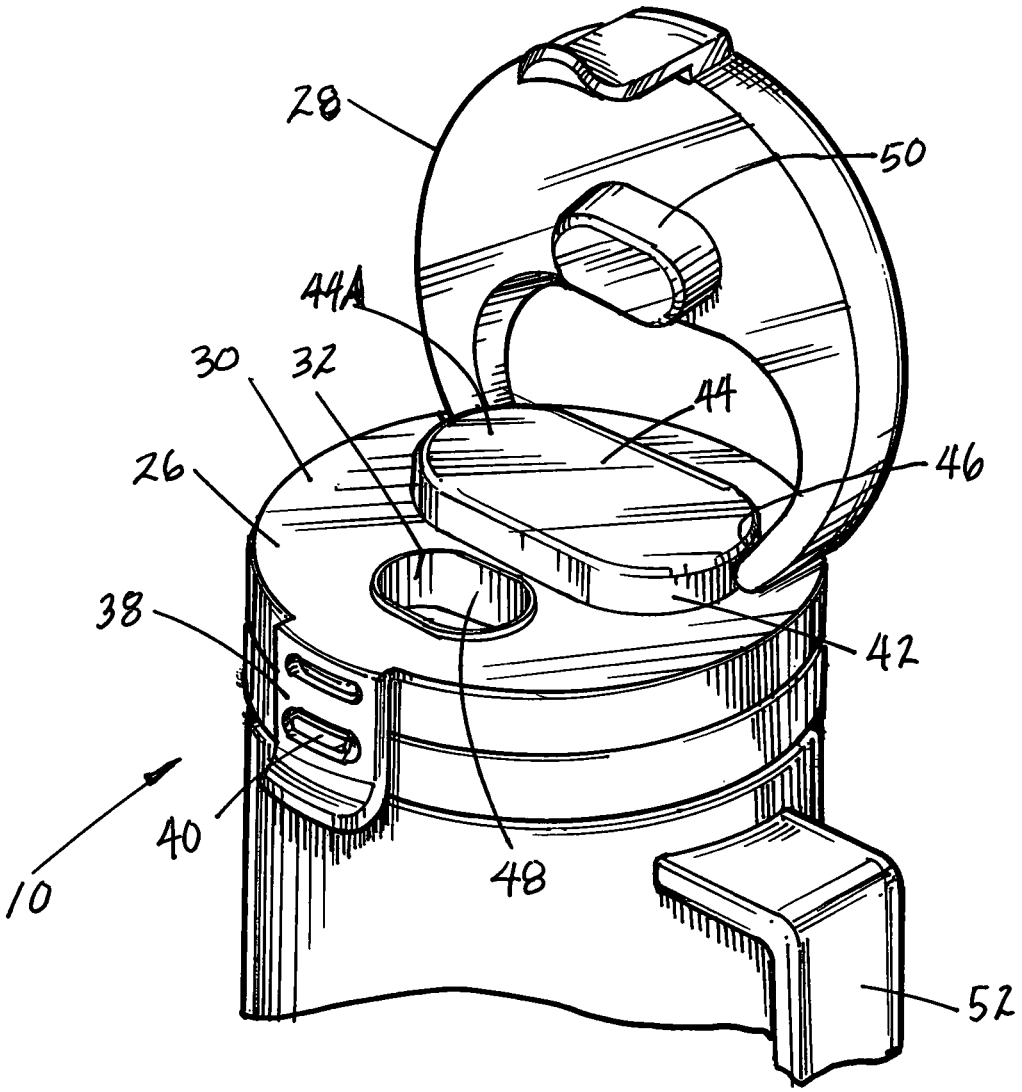
FIG. 9 is a fragmentary perspective view of the beverage-container holder with the secondary lid in an open position and the primary lid in its closed position.

Primary lid 26 is attached to upper edge 22 of cup 20 by a hinge 36, seen best in FIG. 10, and lid structure 24 is movable about hinge 36 between can-admitting and can-enclosing closed positions. FIG. 10 shows the can-admitting position and FIGS. 1-5 and 7-9 show the can-enclosing position, some with secondary lid 28 closed (FIGS. 1-5 and 7) and some with secondary lid 28 open (FIGS. 8 and 9). Primary lid 26 includes a latch 38 for engagement with a latch-catch 40 at upper edge 22 of cup 20.

Secondary lid 28 is hinged to the primary lid at opposite sides 42 of a turret-like raised portion 44 of main portion 30 of primary lid 26. The hinging is at the locations marked by numeral 46. Turret-like raised portion 44 is adjacent to drinking hole 32 in main portion 30. Secondary lid 28 is movable about the hinging between a first position (see FIGS. 1-5 and 7, particularly FIG. 7) which exposes drinking hole 32 in primary lid 26 and a second position (see FIGS. 8 and 9) which closes drinking hole 32. In its closed position, secondary lid 28 also covers an area of primary lid 26 around drinking hole 32. Raised portion 44 and secondary lid 28 have top surfaces 44A and 28A, respectively, which are co-planar when secondary lid 28 is in its closed position.

As illustrated in FIGS. 7-9, primary lid 26 includes a flow-directing member 48 which extends downwardly from the inner-facing wall of primary lid 26 and, as illustrated in FIGS. 7 and 8, through the aperture in resiliently-deformable disk 34 of primary lid 26, and through can opening 18 when primary lid 26 is in its closed position. Flow-directing member 48 is tubular, and is configured to engage the edges of can opening 18.

As also illustrated in FIGS. 7-9, secondary lid 28 includes an underside protrusion 50 that extends into drinking hole 32 in primary lid 26 when secondary lid 28 is in its second (i.e., open) position. Underside protrusion 50 is configured to plug drinking hole 32 when secondary lid 28 is in its closed position, to form a fluid-impermeable seal. More specifically, protrusion 50 engages the inner walls of flow-directing member 48 to form such fluid-impermeable seal. When primary lid 26 is moved to its can-admitting position as shown in FIG. 10, the engagement of protrusion 50 with the inner walls of flow-directing member 48 continues, with both primary and secondary lids 26 and 28 pivoting together around hinge 36.

As shown in several of the figures, cup 20 includes a handle 52 to enable the device to be used in an easy fashion.

Figure 11:
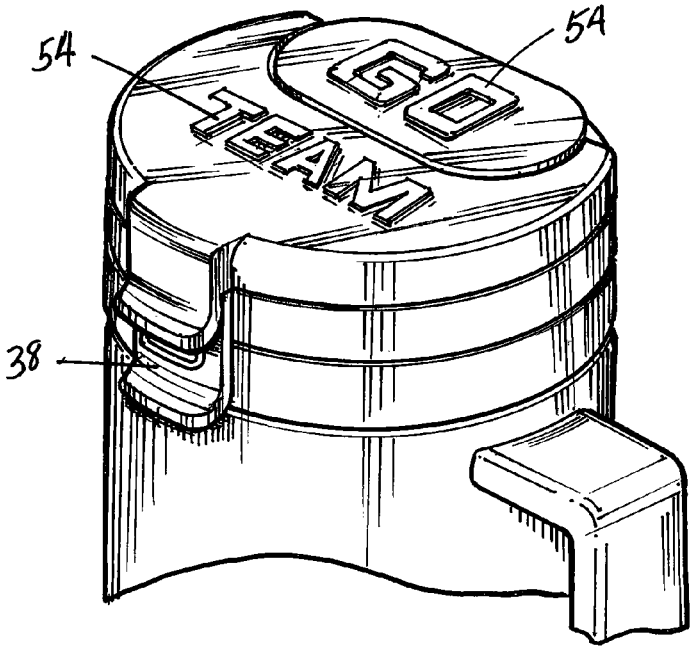
FIG. 11 is fragmentary perspective view of an embodiment including readable indicia formed on the top surfaces.

As illustrated in FIG. 11, top surface 28A of secondary lid 28 and top surface 44A of turret-like raised portion 44 of primary lid 26 have readable indicia 54 thereon. Indicia can be prepared in a thermoforming process used to make the parts, or can be done by application of decals, printing, or any of a variety of other known methods.

While the principles of this invention have been described in connection with specific embodiments, it should be understood clearly that these descriptions are made only by way of example and are not intended to limit the scope of the invention.

The invention claimed is:

1. An insulating beverage-container holder including (a) a lower container-receiving cup having an upper edge and (b) an upper lid structure, the cup and lid structure together configured to selectively admit, enclose and allow removal of a standard-shape beverage can having a bead and a top surface with an offset opening near the bead, wherein the upper lid structure comprises:

a primary lid including (i) a main portion secured to the upper edge of the cup, covering the cup thereby to enclose the can and defining an offset drinking hole alignable with the can opening, the main portion having an underside, and (ii) a disk of resiliently-deformable insulating material on the underside of the main portion and disposed to form a fluid-impermeable seal about the can opening, the disk having an aperture aligned with the drinking hole; and a secondary lid hinged to the primary lid about a hinge axis extending along the main portion, the secondary lid being movable between a first position exposing the drinking hole and a second position closing the drinking hole and covering a top-surface area of the main portion therearound.

2. The insulating beverage-container holder of claim 1 wherein the primary lid is hinged to the upper edge of the cup, the lid structure being selectively movable about the hinge between a can-admitting/removing open position and a can-enclosing closed position.

3. The insulating beverage-container holder of claim 2 wherein the primary lid includes a latch for engagement in the closed position with a latch-catch at the upper edge of the cup.

4. The insulating beverage-container holder of claim 2 wherein the primary lid includes a flow-directing member disposed to extend downwardly from the underside of the main portion and through a plane defined by the can opening when the primary lid is in the closed position.

5. The insulating beverage-container holder of claim 4 wherein the flow-directing member is tubular.

6. The insulating beverage-container holder of claim 2 wherein the secondary lid includes an underside protrusion disposed to extend into the drinking hole when the secondary lid is in the second position.

7. The insulating beverage-container holder of claim 6 wherein the underside protrusion is configured to plug the drinking hole when the secondary lid is in the second position, thereby forming a fluid-impermeable seal.

8. The insulating beverage-container holder of claim 7 wherein:

the primary lid includes a flow-directing member disposed to extend downwardly from the underside of the main portion through a plane defined by the can opening when the primary lid is in the closed position, the flow-directing member having inner walls; and the protrusion extends into the flow-directing member and engages inner walls thereof to form the fluid-impermeable seal.

9. The insulating beverage-container holder of claim 8 wherein the cup includes a side handle.

10. The insulating beverage-container holder of claim 1 wherein the main portion includes a turret-like raised portion adjacent to the drinking hole, the secondary lid being hinged at hinge points on opposite sides of the turret-like raised portion.

11. The insulating beverage-container holder of claim 10 wherein the turret-like raised portion and the secondary lid have substantially co-planar top surfaces when the secondary lid is in the second position.

12. The insulating beverage-container holder of claim 10 wherein the turret-like raised portion and the secondary lid have top surfaces at least one of which bears readable indicia.

13. The insulating beverage-container holder of claim 1 wherein the resiliently-deformable disk of the primary lid is disposed to sealingly engage the bead of the beverage can when the primary lid is in the closed position.

14. An insulating beverage-container holder including (a) a lower container-receiving cup having an upper edge and (b) an upper lid structure, the cup and lid structure together configured to selectively admit, enclose and allow removal of a standard-shape beverage can having a bead and a top surface with an offset opening near the bead, wherein the upper lid structure comprises:

a primary lid secured to the upper edge of the cup and covering the cup thereby to enclose the can, the primary lid including (i) a main portion defining an offset drinking hole alignable with the can opening, the main portion having an underside, and (ii) a disk of resiliently-deformable insulating material on the underside of the main portion and disposed to form a fluid-impermeable seal about the can opening, the disk having an aperture aligned with the drinking hole; and a secondary lid hinged to the primary lid about a hinge axis extending along the main portion, the secondary lid being movable between a first position exposing the drinking hole and a second position closing the drinking hole and covering a top-surface area of the main portion therearound, the secondary lid being disposed in the second position to form a fluid-impermeable secondary seal 360° around the drinking hole, the secondary seal being formed at points of frictional contact between the underside of the secondary lid and an adjacent upperside of the primary lid.

15. An insulating beverage-container holder including (a) a lower container-receiving cup having an upper edge and (b) an upper lid structure, the cup and lid structure together configured to selectively admit, enclose and allow removal of a standard-shape beverage can having a bead and a top surface with an offset opening near the bead, wherein the upper lid structure comprises:

a primary lid secured to the upper edge of the cup and covering the cup thereby to enclose the can, the primary lid including (i) a main portion defining an offset drinking hole alignable with the can opening, the main portion having an underside, and (ii) a disk of resiliently-deformable insulating material on the underside of the main portion and disposed to form a fluid-impermeable seal about the can opening, the disk having an aperture aligned with the drinking hole, and (iii) an edge-engaging circumferential rim disposed to form a fluid-impermeable seal 360° around the edge of the cup; and a secondary lid hinged to the primary lid about a hinge axis extending along the main portion, the secondary lid being movable between a first position exposing the drinking hole and a second position closing the drinking hole and covering a top-surface area of the main portion therearound.

16. The insulating beverage-container holder of claim 15 wherein one of the edge-engaging circumferential rim and the edge of the cup is of a deformably-resilient polymer and the other is of hard plastic.

17. The insulating beverage-container holder of claim 16 wherein the primary lid is hinged to the upper edge of the cup, the lid structure being selectively movable about the hinge between a can-admitting/removing open position and a can-enclosing closed position.

18. The insulating beverage-container holder of claim 14 wherein the primary lid is hinged to the upper edge of the cup, the lid structure being selectively movable about the hinge between a can-admitting/removing open position and a can-enclosing closed position.

* * * * *